United States Patent [19]

Sloate

[11] Patent Number: 4,683,915

[45] Date of Patent: Aug. 4, 1987

[54] PILOT CONTROLLED VALVES

[76] Inventor: Harry M. Sloate, 526 Lakeshore Dr., Barrington, Ill. 60010

[21] Appl. No.: 705,076

[22] Filed: Feb. 25, 1985

[51] Int. Cl.[4] ..... F15B 13/043

[52] U.S. Cl. ..... 137/625.63; 91/375 R; 91/376 R; 137/625.6; 137/625.64

[58] Field of Search ..... 91/375 R, 376 R; 137/625.6, 625.63, 625.64; 251/30.01

[56] References Cited

U.S. PATENT DOCUMENTS

| | | | |
|---|---|---|---|
| 123,174 | 1/1872 | Hopkins | 137/625.63 |
| 2,600,348 | 6/1952 | Walthers | 137/625.6 |
| 2,615,466 | 10/1952 | Garde . | |
| 2,621,676 | 12/1952 | Loft . | |
| 3,023,782 | 3/1962 | Chaves, Jr. et al. . | |
| 3,106,224 | 10/1963 | Moss . | |
| 3,125,002 | 3/1964 | McCombs | 91/375 R X |
| 3,174,406 | 3/1965 | Hague et al. . | |
| 3,219,060 | 11/1965 | Pearl et al. . | |
| 3,386,457 | 6/1968 | Adams . | |
| 3,405,600 | 10/1968 | Ballard et al. . | |
| 3,420,141 | 1/1969 | Hague et al. . | |
| 3,566,919 | 3/1971 | Vanderlaan . | |
| 3,568,718 | 3/1971 | Wilke . | |
| 3,665,807 | 5/1972 | Bartholomaus et al. | 91/378 X |
| 3,674,041 | 7/1972 | Beals . | |
| 3,696,835 | 10/1972 | Pauliukonis . | |
| 4,145,956 | 3/1979 | Rumrill et al. | 137/625.64 X |
| 4,243,062 | 1/1981 | Shelton . | |
| 4,281,676 | 8/1981 | Morris . | |
| 4,368,750 | 1/1983 | Burton . | |
| 4,371,178 | 2/1983 | Ott . | |
| 4,545,409 | 10/1985 | Luhmer | 251/30.01 X |

OTHER PUBLICATIONS

Brochure entitled "JET-PIPE Servovalves from Atchley Controls", dated 11-10-82.

Product literature of Olsen Controls, Inc. on Linear Electro-Hydraulic Pulse Drive, Model LS-300.

Advertisement for Double A's Solenoid Valves.

Picture of a MOOG Servovalve.

Picture of an Air Directional Spool Valve with a Solenoid Controlled Pilot Stage.

*Primary Examiner*—Gerald A. Michalsky

*Attorney, Agent, or Firm*—Willian Brinks Olds Hofer Gilson & Lione Ltd.

[57] ABSTRACT

A new pilot valve for spool-type valves and cartridge-type valves is disclosed. In both types of valve, the valve body (spool or cartridge) is provided with a cylindrical bore and first and second radial bores on opposite sides of a land on the valve body. The valve body is slidable within the axial bore of a valve housing. The valve housing is provided with a pressure inlet port, at least one service port, and usually at least one pressure return port, the ports being axially spaced apart. In a central position, a land of the valve body isolates the pressure inlet port from the pressure return port and/or the service port, one of the radial bores is in fluid communication with the pressure inlet port, and the other radial bore is in fluid communication with either a pressure return port or service port. A control rod is inserted in the cylindrical bore of the valve body and rotatable therein. The control rod is shaped to selectively open or close the radial bores to create a pressure imbalance across the valve body, thereby causing the valve body to shift in an axial direction. The control rod can be machined into different shapes to effect different degrees of control of the valve body movement (i.e. proportional versus directional control). The present invention is described for various types of spool valves and for a cartridge valve.

15 Claims, 19 Drawing Figures

FIG. 8
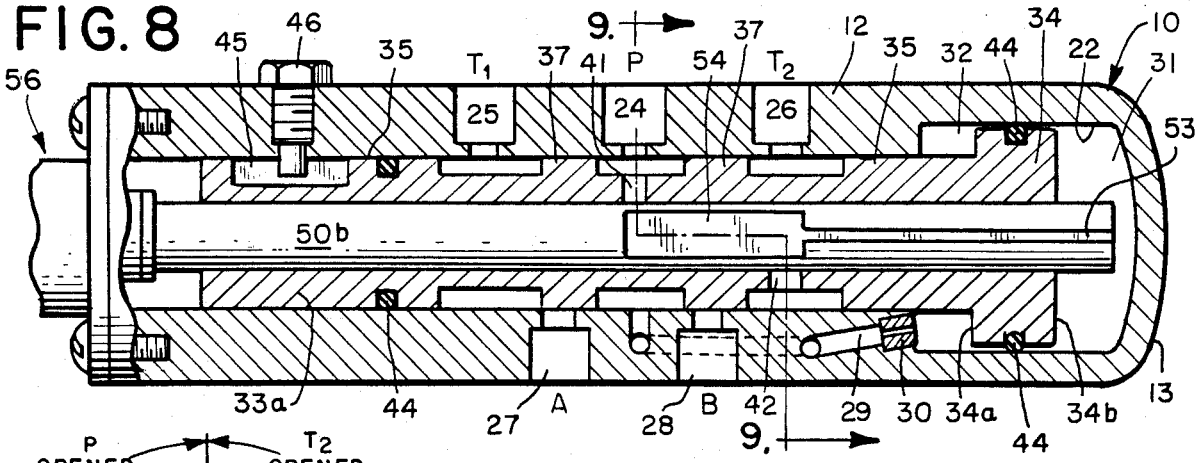
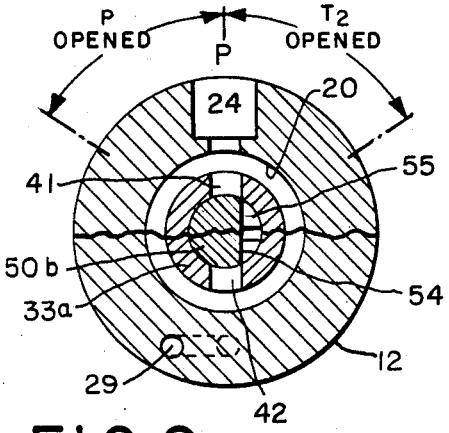
FIG. 9
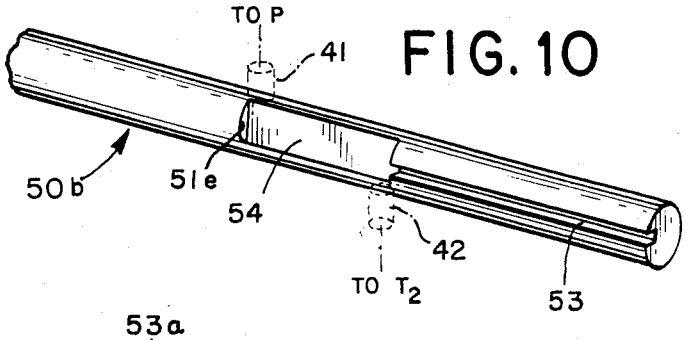
FIG. 10
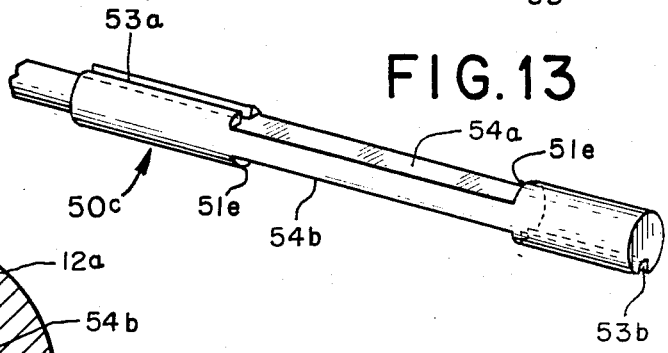
FIG. 13
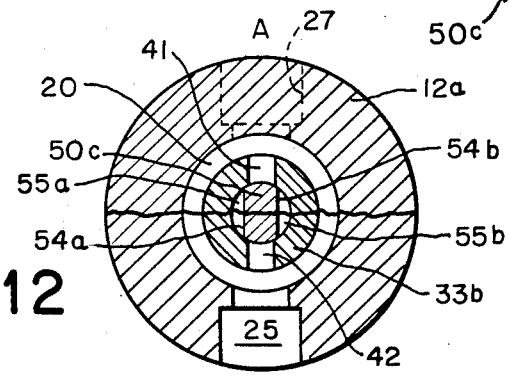
FIG. 12
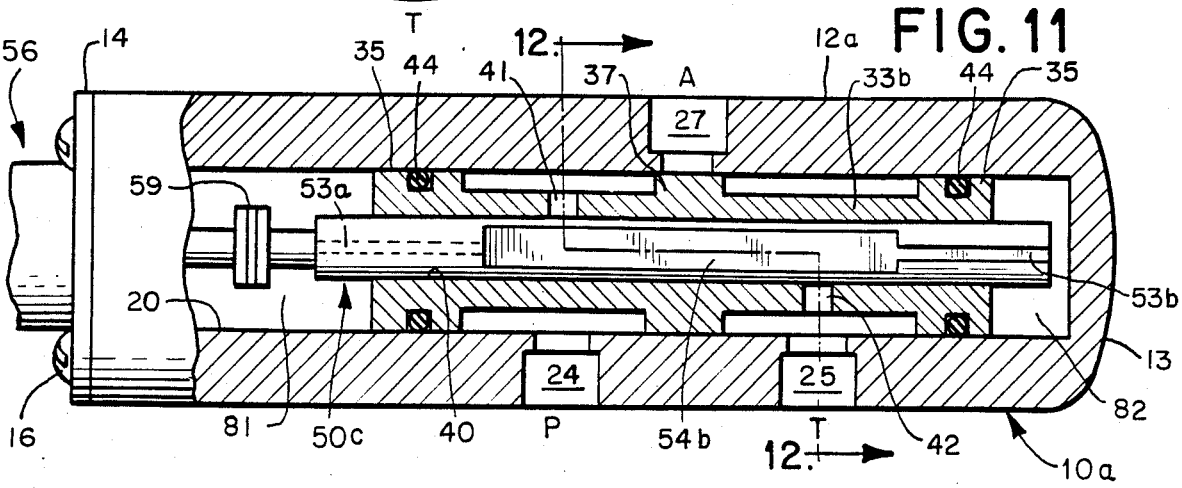
FIG. 11

FIG. 14
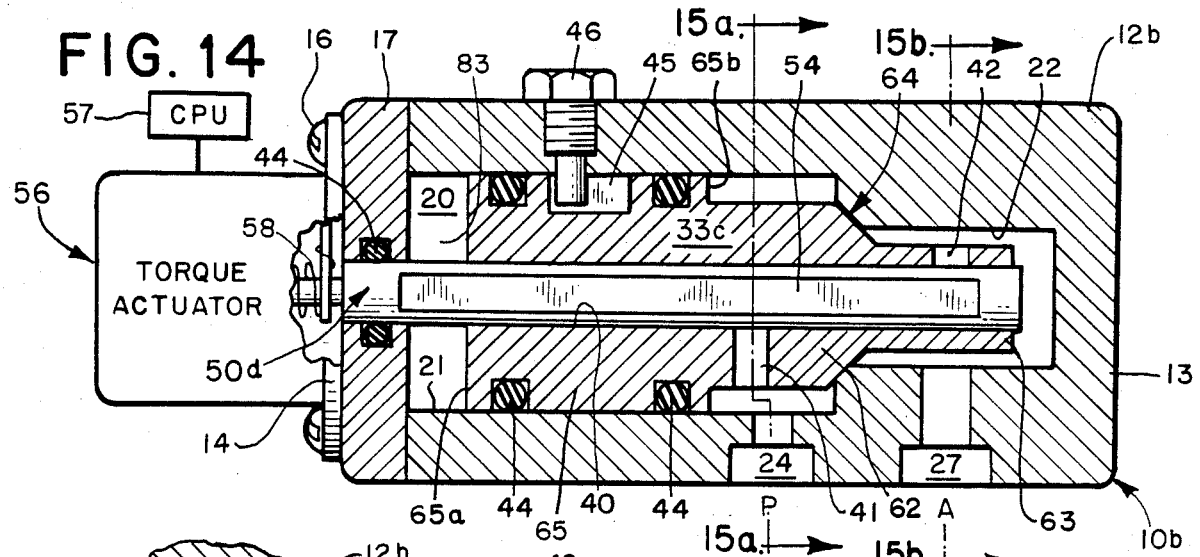
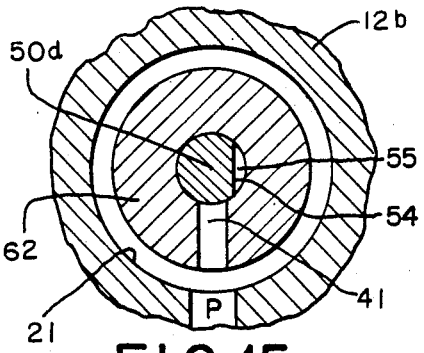
FIG. 15a
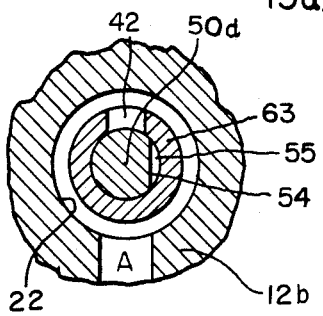
FIG. 15b
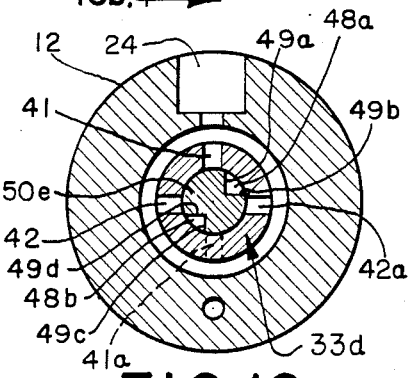
FIG. 16a
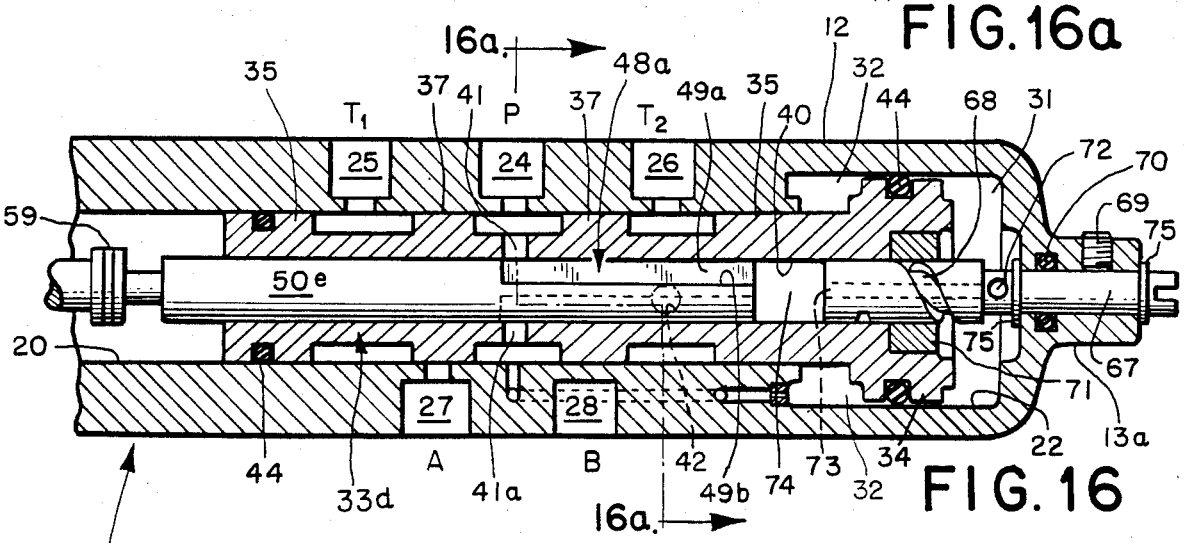
FIG. 16
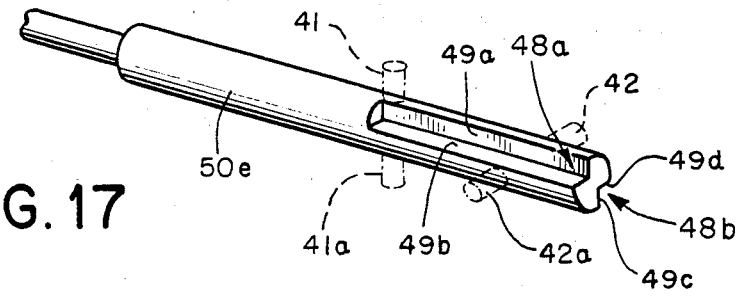
FIG. 17

PILOT CONTROLLED VALVES

BACKGROUND OF THE INVENTION

This invention relates to pilot controlled valves and, in its presently preferred embodiments, to a new and improved pilot stage valve for use in spool-type valves and cartridge-type valves.

Spool-type valves are typically used to control the flow of fluid, such as hydraulic oil, water or air. The size and diameter of the spool determine the flow capacity of the valve. The position of the spool within its valve body controls the amoun and direction of fluid flow through the valve. Because the fluid flow forces and spool mass are typically high, pilot stage valves are used to control the spool position.

There are generally three types of pilot stages for spool-type valves: directional control, proportional control, and servo control. The directional control pilot valve is used to turn fluid flow on and off. This valve is used in the majority of applications. The proportional control pilot valve controls the amount of fluid flow through the valve. The use of these valves in applications is increasing. Servo-type pilot valves use mechanical feedback from the spool to the pilot stage to control spool position. These valves are used in high performance, proportional control applications.

One conventional type of directional spool valve uses a solenoid controlled pilot stage. A first solenoid and iron plunger are attached to one end of the valve housing, and a second solenoid and iron plunger are attached to the opposite side of the valve housing. The solenoids are alternately energized to move the spool and turn the fluid flow on and off. Specifically, when the first solenoid is energized it forces its iron plunger in a direction which moves the spool to turn on fluid flow. When the second solenoid is energized its iron plunger returns the spool to the off position.

This type of conventional directional valve has several drawbacks. The two solenoids and their associated electrical connections add bulk, weight, and significant power consumption to the valve package. The iron slugs are relatively heavy and thus require a lot of electrical energy to be moved by the solenoids. Twenty-four volts and one amp are typical electricity requirements, which computes to twenty-four watts of power. The solenoids also have a relatively long response time, generally around 100 milliseconds.

One type of conventional proportional valve also uses a solenoid controlled pilot stage. In this valve, however, a solenoid and its plunger are attached to only one end of the spool. A spring is attached to the other end of the spool. When the solenoid is energized it moves its plunger in a direction to push the spool against the bias of the spring. The force of the spring provides proportional control of the flow of fluid. When the solenoid is de-energized the spring forces the spool to the off position.

This type of proportional valve also shares the drawbacks of the solenoid controlled directional control pilot valve. Specifically, high electrical current, and thus power, is necessary to move the spool. Moreover, the spring force on the spool is not well suited for high pressure applications.

A widely used servo-type valve is disclosed in U.S. Pat. No. 3,023,782 (Chaves). This valve uses a torque motor pilot stage with negative feedback provided by a flapper 73 in mechanical contact with the spool. The flapper shifts the spool, which can be subject to large fluid forces in response to a small electrical signal to the torque motor. Thus, the flapper provides substantial fluid amplification. The position of the flapper is negatively fed back to the torque motor to control the spool position. This negative feedback provides linearity and minimizes hysteresis.

While the Chaves servo valve provides some advantages, it also has significant disadvantages. These valves are complex and expensive to make. The current price for a 10 gallon per minute (gpm) valve is around $1000.00. Furthermore, these valves are susceptible to clogging due to the small mechanical tolerances (on the order of 0.005 inch) of the flapper design. Thus, extensive filtering of hydraulic fluid, such as oil, is necessary to avoid contamination problems.

Another servo operated spool valve is disclosed in U.S. Pat. No. 3,106,224 (Moss). This patent discloses a spool 1 and a cylindrical spindle 13, which extends through an axial bore in the spool and the two ends of the valve housing 7. Two helical grooves 15 and 16 are formed in the surface of the spindle and are spaced from each other by approximately one-half helical pitch, so that each groove extends from one end of the valve housing cavity past a pair of diametrically opposed radial bores 17 in the spool. In its central position, the radial bores should be inside the central port 3 of the valve housing, and each groove should uncover equal parts of one of the radial bores.

The spool is maintained in its central position by a continuous flow of oil through the valve housing and spool that provides equal fluid pressure at both ends of the housing bore. In particular, the oil flows along two branches from the pressure inlet 24, through ports 2 and 4, passages 20 and 22, and orifices 21 and 23, to the two end chambers of the bore in housing 7, through the grooves 15 and 16 and the radial bores 17 to the drain port 12. In this central "null" position, lands 5 and 6 block the flow of oil through the service ports 10 and 11.

In order to move the spool axially, the spindle 13 is rotated. This will cause one groove to uncover a greater portion of one radial bore and the other groove to cover a greater portion of the opposite radial bore. As a result, the fluid pressure in one end chamber of the valve housing will be greater than the other, and the spool will move towards the chamber of lower pressure until the fluid pressure in each chamber is equal. At this point, each radial bore will be uncovered the same amount again. The axial movement of the spool is proportional to the rotary displacement of the spindle 13.

The Moss servo valve, at first blush, may appear to be less complex and more desirable than the Chaves servo valve. However, the Moss servo valve also has some significant drawbacks. The Moss valve is designed to have continuous oil flow, even at null, between both ends of the valve housing to balance the pressure across the spool. This continuous flow requirement complicates the design and manufacture of the valve. The spindle grooves 15 and 16 and radial bores 17 must be designed in a relationship that facilitates constant flow. The passages 20 and 22 and orifices 21 and 23 must be machined into the outer lands 18 and 21 of the spool. Moreover, the orifices 21 and 23 must be the same size so that each end chamber has about one-half of the fluid pressure at the null position. The orifices and radial holes should also be small to minimize flow at null. The small holes, however, are more prone to contamination.

SUMMARY OF THE INVENTION

The present invention is directed to an improved pilot control for valves. The present invention can used in both spool-type valves and cartridge-type valves.

According to this invention, a unique valve body and control rod are used in a valve housing having an axial bore closed at one end. The valve body has at least one land, a cylindrical bore extending the length of the valve body, and two radial bores axially spaced apart from each other on opposite sides of the land. The control rod is inserted in the cylindrical bore of the valve body and is rotatable therein. The control rod is shaped so that in a first angular position it covers both radial bores, and in a second position uncovers at least one radial bore.

In one preferred embodiment of the present invention, the valve body is a spool in a spool-type valve. The spool has two outer lands and at least one inner land, a cylindrical bore extending the length of the spool, and first and second radial bores on opposite sides of an inner land. The spool is slidable in the axial bore of a valve housing. The housing is provided with a pressure inlet port, a pressure return port, and a service port. All the ports communicate with the axial bore and are axially spaced apart so that when the spool is in a first axial position, the pressure inlet port is isolated from the pressure return port and the service port is blocked by an inner land. Also, in the first axial spool position the first radial bore is in fluid communication with the pressure inlet port, and the second radial bore is in fluid communication with the pressure return port. The control rod covers both radial bores in a first angular position and uncovers at least the first radial bore in a second angular position.

In another preferred embodiment of the present invention, the valve body is a cartridge in a cartridge-type valve. The cartridge is slidable within the axial bore of a valve housing. The valve housing bore has a first diameter portion and a second diameter portion, which is a different size than the first diameter portion. The cartridge is provided with a first land closely received in the first diameter portion, a second land having a diameter smaller than the first diameter portion, and a third land having a diameter smaller than the second diameter portion. The cartridge also has a cylindrical bore extending the length of the cartridge, a first radial bore in the second land, and a second radial bore in the third land. The housing is provided with a pressure inlet port communicating with the first diameter portion, a service port communicating with the second diameter portion, and a valve seat between the ports. The pressure inlet and service ports are axially spaced so that when the cartridge is positioned in the valve housing, the first radial bore is in fluid communication with the pressure inlet port and the second radial bore is in fluid communication with the service port. The control rod is shaped so that in a first angular position the first radial bore is open and the second radial bore is closed, and in a second angular position the first radial bore is closed and the second radial bore is open.

The present invention, whether embodied in a spool-type valve, cartridge-type valve, or other type valve, provides important advantages over conventional pilot controlled valves. The present invention is simple to manufacture and to adapt to existing valves. The spool or cartridge of an existing valve only needs to have a cylindrical bore and two radial bores cut into it and to be equipped with a control rod in accordance with the present invention. The control rod can be easily machined into different shapes to provide directional control or various degrees of proportional control. In either case, the present invention is designed to cut off fluid flow at null or when the spool repositions itself, thereby providing inherent feedback.

Another advantage of the present invention is that the size and shape of the radial bores is not as critical as in the Moss design. In fact, it is best that the radial bores in the present invention be large to prevent contamination and spaced apart to minimize leakage.

Still another advantage of the present invention is that the control rod can be actuated by a low power actuator since the control rod has low mass and is subject to low frictional forces. Moreover, the control rod controls substantial fluid volumes, thereby providing fluid amplification without the cost of high input power. The low power actuator is well suited for direct computer control.

The invention itself, together with further objects and attendant advantages, will best be understood by reference to the following detailed description taken in conjunction with the drawings.

BRIEF DESCRIPTION OF THE DRAWINGS

FIG. 8 is a partial longitudinal sectional view of a third preferred embodiment of the present invention in a spool-type valve.

FIG. 9 is a cross-sectional view taken along lines 9—9 of FIG. 8.

FIG. 10 is a perspective view of the control rod used in the embodiment shown in FIGS. 8 and 9.

FIG. 11 is a partial longitudinal sectional view of a fourth preferred embodiment of the present invention in a spool-type valve.

FIG. 12 is a cross-sectional view taken along lines 12—12 of FIG. 11.

FIG. 13 is a perspective view of the control rod used in the embodiment shown in FIGS. 11 and 12.

FIG. 14 is a longitudinal sectional view of a preferred embodiment of the present invention in a cartridge-type valve.

FIG. 15*a* is a cross-sectional view taken along lines 15*a*—15*a* of FIG. 14.

FIG. 15*b* is a cross-sectional view taken along lines 15*b*—15*b* of FIG. 14.

FIG. 16 is a partial longitudinal sectional view of a fifth preferred embodiment of the present invention in a spool-type valve.

FIG. 16*a* is a cross-sectional view taken along lines 16*a*—16*a* of FIG. 16.

FIG. 17 is a perspective view of the control rod used in the embodiment shown in FIGS. 16 and 16*a*.

DETAILED DESCRIPTION OF PREFERRED EMBODIMENTS

Figure 1:
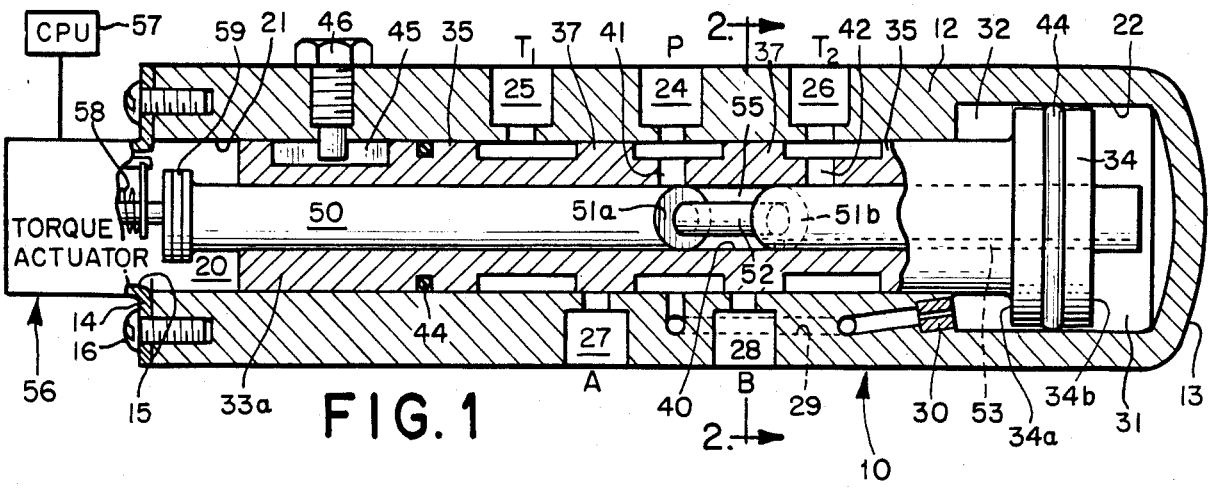
FIG. 1 is a longitudinal sectional view of a first preferred embodiment of the present invention in a spool-type valve.
Figure 2:
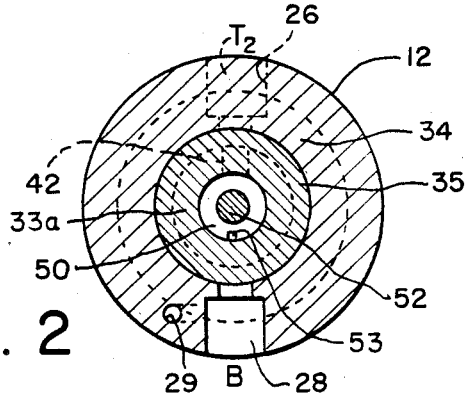
FIG. 2 is a cross-sectional view taken along lines 2—2 of FIG. 1.

The present invention will now be described in connection with the embodiments of the invention shown in the drawings. These drawings depict the present invention in five different types of spool valves and one type of cartridge valve. It should be understood that the present invention is not intended to be limited to the embodiments shown in the drawings. Rather, the present invention is intended to apply to valves generally, especially spool-type valves and cartridge-type valves, and the embodiments shown in the drawings are representative. In fact, it will be apparent to those skilled in the art that the present invention can be adapted to many variations of the types of spool valves and cartridge valves shown in the drawings. With this in mind, each of the embodiments of the present invention shown in the drawings will now be described.

FIGS. 1–6 show the present invention embodied in a 2-position, 4-way spool valve 10 in various stages of operation. The spool valve includes a valve housing 12 having a closed end 13 and an open end which is closed by plate 14. The plate 14 is secured to the valve housing 12 by screws 16. An axial bore 20 extends longitudinally through the valve housing 12 between the closed end 13 and the plate 14. The axial bore 20 has a first diameter portion 21 adjacent the plate 14 and a second diameter portion 22 adjacent the closed end 13 and adjoining the first diameter portion 21. The second diameter portion 22 is larger in diameter than the first diameter portion 21.

The valve housing 12 is also provided with a pressure inlet port 24 (P), a first pressure return port 25 (T1), a second pressure return port 26 (T2), a first service port 27 (A), and a second service port 28 (B). All of the ports 24–28 are axially spaced apart and communicate with the axial bore 20. The valve housing 12 also has a passage 29 which connects the pressure inlet port 24 (P) to the second diameter portion 22 of the axial bore 20. A metering orifice 30 is provided in the end of the passage 29 adjacent the second diameter portion. As shown best in FIG. 2, the passage 29 is circumferentially displaced in the valve housing 12 from the second service port 28 (B).

A valve body in the form of a spool 33*a* is provided to slide axially within the axial bore 20 of the valve housing 12. The spool 33*a* has a control land 34 which is closely received within the second diameter portion 22 of the housing bore 20, and two outer lands 35 and two inner (or intermediate) lands 37 which are closely received within the first diameter portion 21 of the housing bore 20. The control land 34 and the outer land 35 opposite from it are fitted with o-rings 44 to provide a seal at the ends of the spool 33*a*. The other lands of the spool are not provided with o-rings. Instead, they are machined to provide approximately 1/1000th of an inch clearance between the lands and the surface of the axial bore 20. The control land 34 and the outer land 35 opposite it can also be machined in this manner and omit the o-rings 44. It should also be noted that the lands can be provided with circumferential centering grooves to counteract any pressure imbalances, as is commonly done in the art.

The control land 34 divides the second diameter portion 22 of valve housing bore 20 into a first chamber 31 and a second chamber 32. The control land 34 adjoins the adjacent outer land 35 so that the area of the left side 34*a* of control land in the second chamber 32 is less than the area of the right side 34*b* of the control land in the first chamber 31. It is preferred that the area of the left side 34*a* of the control land is one-half the area of the right side 34*b* of the control land.

The spool body 33*a* has a cylindrical bore 40 drilled into it that extends completely through its longitudinal axis. A first radial bore 41 and a second radial bore 42 are also cut into the spool 33*a*. These radial bores provide a means for fluid communication between the valve housing bore 20 and the spool cylindrical bore 40. It is important that the first and second radial bores 41 and 42 are spaced apart on opposite sides of an inner land 37.

A keyway passage 45 is also carved into the spool 33*a*. This keyway passage 45 cooperates with a key 46 in the valve housing 12 to prevent the spool 33*a* from rotating; the spool 33*a* should just slide axially in the valve housing bore 20.

A cylindrical control rod 50 is inserted in the cylindrical bore 40 of the spool 33*a* and rotatable therein. This control rod is shown in the drawings to extend beyond the end of the spool 33*a* into the first chamber 31. The control rod could also terminate inside the cylindrical bore 40, it only being necessary that the end of the control rod always extend beyond the second radial bore 42 and be sufficiently stiff to keep itself in place, regardless of the axial position of the spool 33*a*. It is preferred that the control rod fit snugly within the cylindrical bore 40 to minimize leakage. A tolerance of 1/1000th of an inch should suffice. Of course, where tight tolerances and leakage are not critical, a looser fit reduces friction for the control rod 50.

A central portion of the control rod 50 is shaped so that the control rod has two intermediate faces 51*a* and 51*b* bridged by a connector rod 52. In the embodiment shown in FIGS. 1—6, the faces 51*a* and 51*b* are cut at supplementary angles of 45 degrees and 135 degrees. The faces 51*a,b* and the connector rod 52 can be machined into, or carved out of, a control rod that is initially a complete cylinder.

The two opposed faces 51*a* and 51*b* define a gap 55 in the cylindrical bore 40 therebetween. When the spool 33*a* is in the central null position (i.e., there is no fluid flow between the pressure inlet port 24 (P) and either service port 27 or 28 or pressure return port 25 or 26), each face 51*a* and 51*b* should be positioned to block one of the radial bores 41 or 42. As will be explained later, the angled contour of the faces 51*a* and 51*b* with respect to the radial bores 41 and 42 provides proportional control of the spool position.

A channel 53 is also machined into the control rod 50. The channel 53 extends between the gap 55 and the end of the control rod 50 which communicates with the first chamber 31 of the second diameter portion 22.

Figure 3:
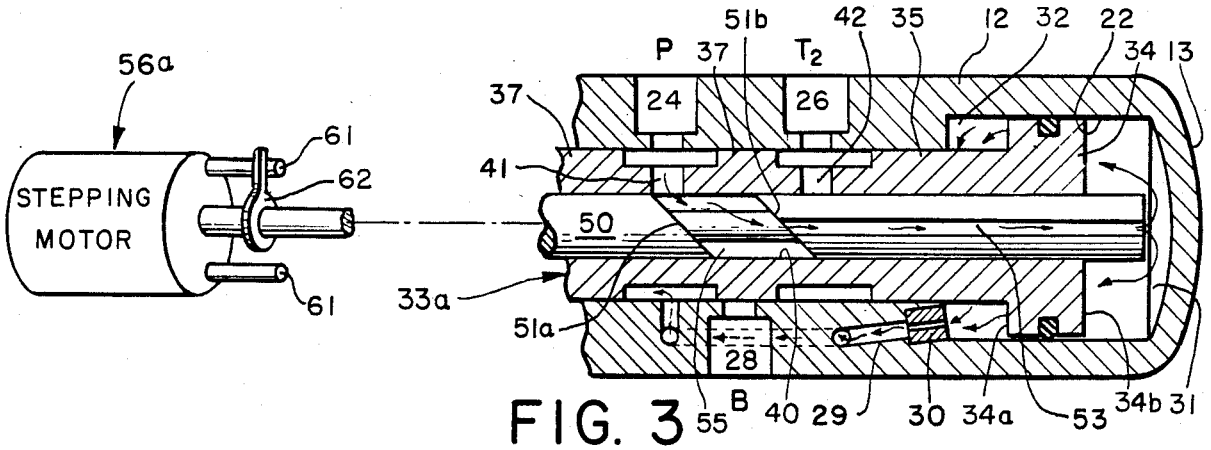
FIG. 3 is a partial longitudinal sectional view of the first preferred embodiment of the present invention with the control rod rotated in a first angular direction.
Figure 4:
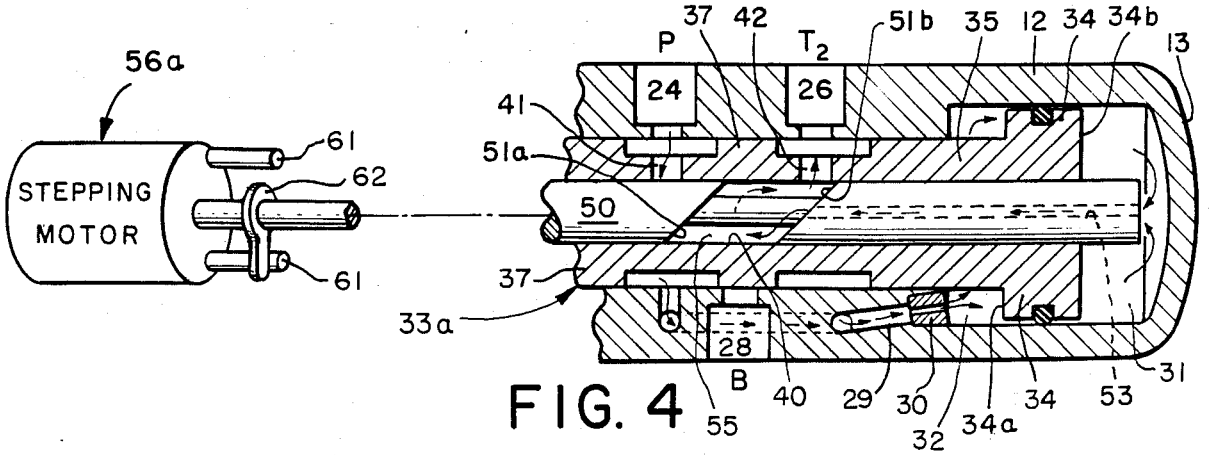
FIG. 4 is a partial longitudinal sectional view of the first preferred embodiment of the present invention with the control rod rotated in a second angular direction.

The left end of the control rod 50 extends through an opening 15 in the end plate 14 beyond the end of the valve housing 12. A conventional seal is provided around this end of the control rod to prevent leakage. Outside the valve housing, the end of the control rod 50 is connected to a torque actuator 56, which is provided to rotate the control rod 50. The torque actuator 56 should maintain the control rod 50 in a fixed axial position with respect to the valve housing 12. As shown in FIGS. 3 and 4, a conventional stepping motor 56*a* can be used in lieu of the torque actuator 56. Two stops 61 and a limit flange 62 can be fixed to the stepping motor 56*a* to limit the degree of rotational travel of the control rod 50. The torque actuator (or stepping motor) used to rotate the control rod 50 can be controlled by a computer 57 (e.g., a microprocessor) because of the low mass of the control rod 50 and the low frictional forces working against it. A torsional bias spring 58 is attached to the control rod 50 to bring the control rod to its angular reference null point shown in FIG. 1 when the torque actuator is not acting on the control rod 50. A flexible coupling 59 is provided at the end of control rod 50 adjacent to the torque actuator 56 to keep the control rod 50 in a parallel relationship with the cylindrical bore 40 if the end of the control rod 50 outside the valve housing 12 is shifted out of alignment for any reason. Preferably, the flexible coupling 59 does not require a high degree of alignment between the axis of the torque actuator 56 and the axis of the spool 33*a*.

The operation of the embodiment shown in FIGS. 1–6 will now be described. FIG. 1 shows the spool 33*a* and the control rod 50 in the central null position. In this position, each inner land 37 of the spool 33*a* blocks one of the service ports 27 and 28 and isolates the pressure inlet port 24 from one of the pressure return ports 25 and 26. Thus, there is no fluid flow between the pressure inlet port 24 and the service ports 27 and 29 or the pressure return ports 25 and 26. The ports 24–28 must be axially spaced apart and the width of the inner lands 35 must be machined to achieve no flow at the central null position.

In the central null position, the control rod 50 should be in its angular reference null position to block both the first and second radial bores 41 and 42. The first radial bore 41 should be in fluid communication with the pressure inlet port 24 (P), and the second radial bore 42 should be in fluid communication with one of the pressure return ports 25 (T1) or 26 (T2). In this embodiment, the second radial bore 42 is in fluid communication with the second pressure return port 26 (T2).

One other point should be mentioned about the central null position. The first chamber 31 and the second chamber 32 of the second diameter portion 22 of the axial bore 20 are filled with fluid (e.g. oil, water, or air). The pressure inlet port 24 constantly supplies fluid to the second chamber 32 via the passage 29 and orifice 30. The valve 10 must be initialized to fill the first chamber 31. (Once the operation of this embodiment is fully explained, it will be apparent to those skilled in the art how the first chamber 31 will automatically fill and set the spool 33*a* to the central null position when fluid is first introduced through the pressure inlet port 24.) Since the fluid in the first chamber 31 has nowhere to go when the control rod 50 is in the reference null position, the spool position will stabilize when the fluid pressure in the first chamber 31 equals one-half the fluid pressure in the second chamber 32 (i.e., P/2).

It is apparent from FIG. 1 that when the spool 33*a* and the control rod 50 are in the central null position, fluid flow between the pressure inlet port 24 and either service port 27 or 28 is blocked off. In order to shift the spool 33*a* axially, left or right, to establish fluid communication between the pressure inlet port 24 and one of the service ports, the control rod 50 is rotated clockwise or counterclockwise.

FIG. 3 shows what happens when the control rod 50 is immediately rotated 90 degrees counterclockwise while the spool 33*a* is in the central null position. The left face 51*a* of the control rod 50 completely uncovers the first radial bore 41, whereas the right face 51*b* keeps the second radial bore 42 completely covered. Fluid from the pressure inlet port 24 then fills the gap 55 and travels to the first chamber 31 (the control chamber) via the channel 53. Because the area of the right side 34*b* of the control land 34 is twice the area of the left side 34*a*, the additional fluid received into the first chamber 31 creates a higher force on the right side 34*b* of the control land, which forces the control land 34 and entire spool 33*a* to the left. The fluid in the second chamber 32 is forced through the metering orifice 30, which provides a viscous damping effect on the spool 33*a*. The size of the orifice 30 is chosen to minimize oscillation and provide smooth spool 33*a* displacement.

As the spool 33*a* shifts to the left, the inner lands 37 uncover the service ports 27 and 28. Fluid flow is thus established between the pressure inlet port 24 (P) and the first service port 27 (A) and between the second service port 28 (B) and the second pressure return port 26 (T2).

Figure 5:
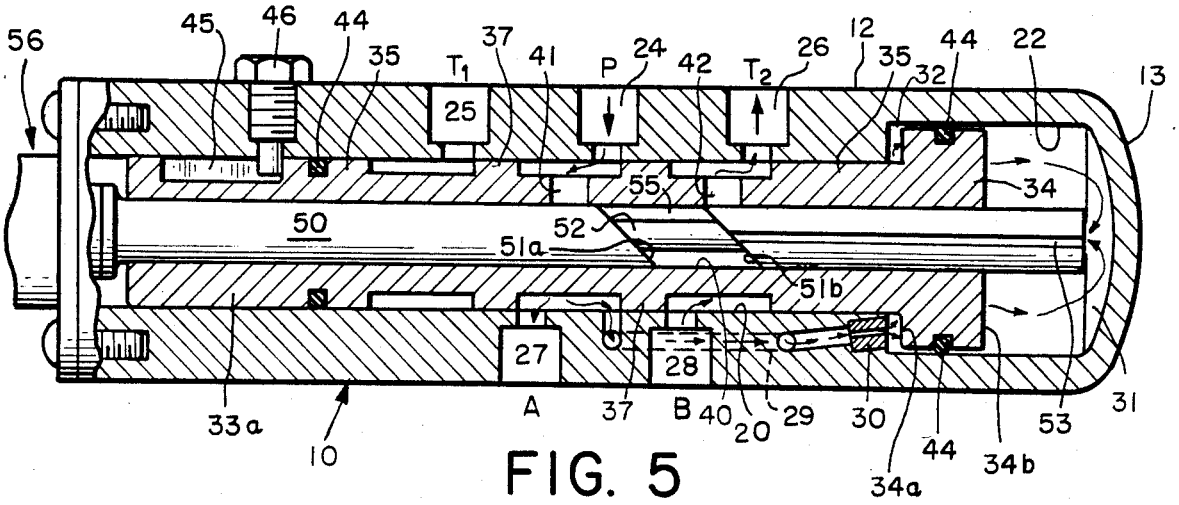
FIG. 5 is a partial longitudinal sectional view of the first preferred embodiment of the present invention with the control rod rotated in a first angular direction and the spool shifted to the left.

As shown in FIG. 5, the spool 33*a* will continue to shift to the left until the first and second radial bores 41 and 42 are both completely covered by the left and right faces 51*a* and 51*b*, respectively, of the control rod 50. At this point, the fluid pressure in the first chamber 31 will equal one-half the fluid pressure in the second chamber 32 (i.e., P/2). Thus, the forces on the spool 33*a* balance and the spool 33*a* does not move. This will be referred to as a general null position.

FIG. 4 shows what happens when the control rod 50 is rotated 90 degrees clockwise while the spool 33*a* is in the central null position. The right face 51*b* of the control rod 50 completely uncovers the second radial bore 42, whereas the left face 51*a* keeps the first radial bore 41 completely covered. The first chamber 31 is then connected to a low pressure tank, the second pressure return port 26 (T2), via the channel 53 and gap 55. The constant pressure on the left side 34*a* of the control land 34 will now force the control land 34 and entire spool 33*a* to the right. The fluid in the first chamber 31 is forced through the channel 53 into the gap 55 and, from there, through the second radial bore 42 into the second pressure return port 26 (T2).

As the spool 33*a* shifts to the right, the inner lands 37 again uncover the service ports 27 and 28. But this time, fluid flow is established between the pressure inlet port 24 (P) and the second service port 28 (B) and between the first service port 27 (A) and the first pressure return port 25 (T1).

Figure 6:
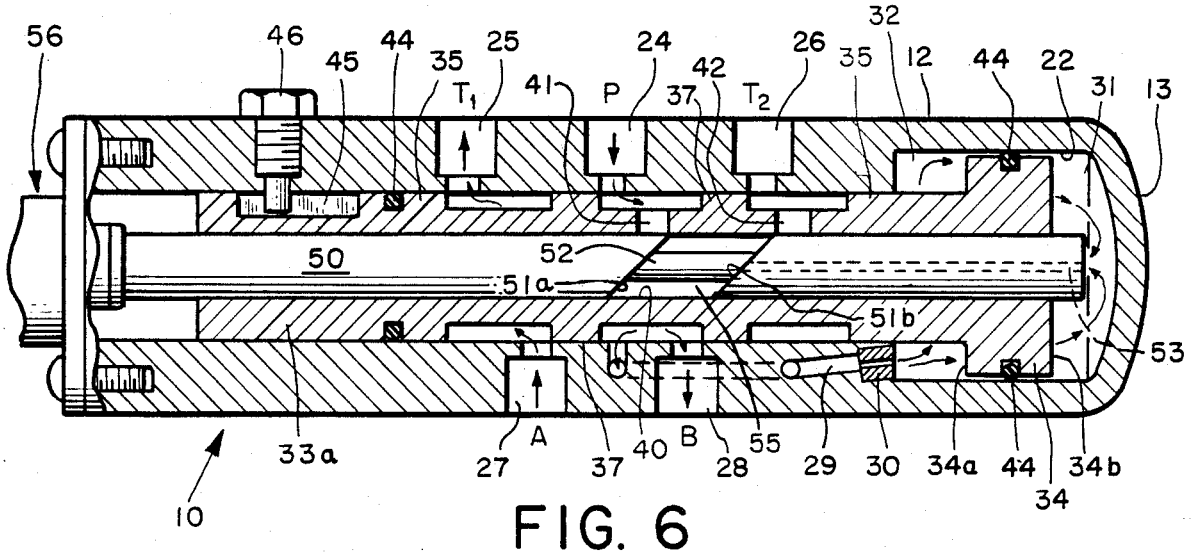
FIG. 6 is a partial longitudinal sectional view of the first preferred embodiment of the present invention with the control rod rotated in a second angular direction and the spool shifted to the right.

As shown in FIG. 6, the spool 33*a* will continue to shift to the right until the first and second radial bores 41 and 42 are both completely covered by the left and right faces 51*a* and 51*b*, respectively, of the control rod 50. Again, at this point, the fluid pressure in the first chamber 31 will equal one-half the fluid pressure in the second chamber 32 (i.e., P/2), and the position of the spool 33*a* will be stable in a null position.

In broad terms, the specially machined control rod 50, in cooperation with the first and second radial bores 41, 42, acts as pilot valve that uses the high pressures of the fluid input from the pressure inlet port to control spools of substantial size. At least three important observations should be made from the method of operation of the pilot valve of the present invention.

First, as the spool 33*a* moves in the direction of closing both radial bores 41 and 42, for example, to the left, the open first radial bore 41 becomes progressively closed. This means that additional pressurized fluid flows into the first chamber 31 at a slower rate, so that the spool 33*a* moves slower as it approaches a null position. Thus, the pilot valve of the present invention provides inherent damping of the spool 33*a*.

Second, the embodiment of the present invention in FIGS. 1–6 provides proportional control. If the control rod 50 were rotated less than 90 degrees in either direction (e.g., 45 degrees), the spool would shift an axial distance proportional to the angular displacement of the control rod, thereby controlling the amount of fluid flow to the service ports A and B. Proportional control is achieved because the spool shifts until both the radial bores 41 and 42 are closed, and because the faces 51*a* and 51*b* of the control rod 50 are cut at a slant. The slanted faces 51*a,b* only open the radial bores 41 and 42 an amount proportional to the angular rotation of the rod, and close the radial bores before the spool 33*a* has completely shifted to one end of travel or the other.

Third, the concept of the present invention, as shown in FIGS. 1–6, provides inherent feedback. The spool 33*a* will shift one way, to the left, for example, until both radial bores 41 and 42 are covered by the control rod 50. If the spool 33*a* overshoots the first radial bore 41 so that it partially uncovers the second radial bore 42, the spool 33*a* will then shift to the right. The spool will continue to shift right or left until both radial bores 41 and 42 are covered by the control rod 50. (This inherent feedback also initializes the spool 33*a* in the central null position when fluid is first introduced into an empty valve housing from the pressure inlet port.)

The remaining figures of the drawings demonstrate how the pilot valve of the present invention can be adapted in other valve embodiments. Except for the proportional control feature, which can be omitted, as explained below, the other advantages of the present invention are present in all the other embodiments, which will be apparent to those skilled in the art. Thus, the following discussion of the other embodiments of the present invention shown will focus on their structural and operational differences from the embodiment described in FIGS. 1–6 above. Like reference numbers will be used for elements of the following embodiments which are essentially the same as the elements of FIGS. 1–6.

Figure 7:
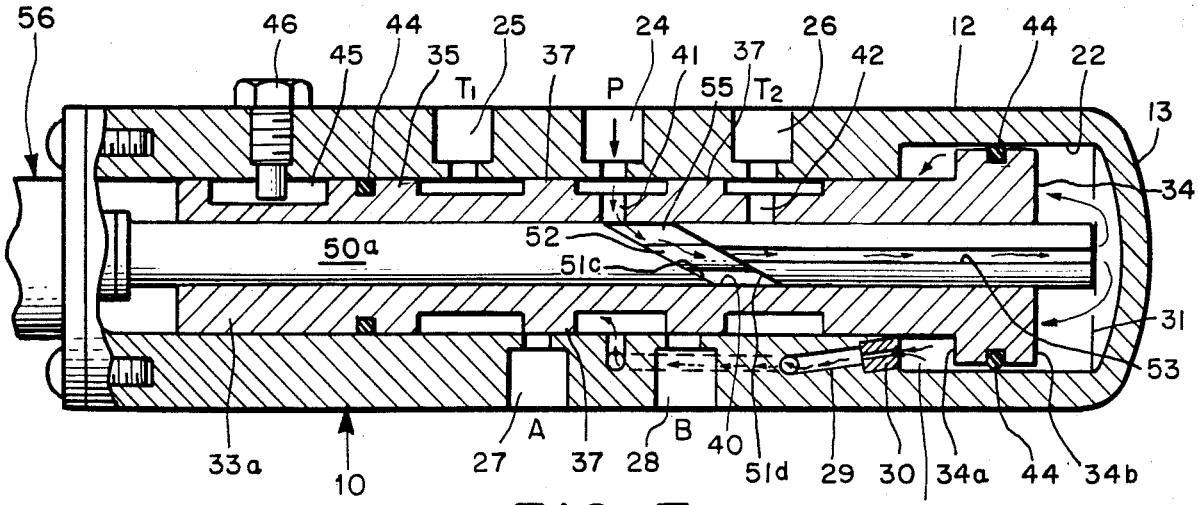
FIG. 7 is a partial longitudinal sectional view of a second preferred embodiment of the present invention in a spool-type valve.

Referring now to FIG. 7, an alternate embodiment of a proportional spool-type valve implementing the present invention is shown. The only structural difference between the valve 10 shown in FIG. 7 from the previously described embodiment is that the control rod 50*a* has two faces at different supplementary angles. The first face 51*c* is cut at a 30 degree angle, and the second face 51*d* is cut at a 150 degree angle. Thus, faces 51*c* and 51*d* have a steeper slant than faces 51*a* and 51*b* of the previous embodiment.

The embodiment shown in FIG. 7 will operate exactly as the embodiment of FIGS. 1–6, except that the control rod 50*a* will provide greater proportional control and fluid amplification. Because the faces 51*c* and 51*d* are steeper, they will uncover a greater portion of the radial bores 41 and 42 than the shallower faces 51*a* and 51*b* for the same degree of angular rotation. The spool 33*a* will then have to shift axially a greater distance to reach the null position where both radial bores are covered. Thus, the steep faces 51*c,d* of the control rod 50*a* provide greater axial movement of the spool 33*a* per angular degree than the shallow faces 51*a,b* of the control rod 50. The control rod 50*a*, therefore, exhibits greater fluid amplification and proportional control.

It should be clear from a comparison of the embodiments of FIGS. 1–6 and FIG. 7 that the degree of proportional control can be easily varied by changing the contour of the faces 51 cut into the control rod 50.

Another type of proportional spool valve that embodies the present invention but does not have slanted faces cut into the control rod is shown in FIGS. 16–17. The control rod 50*e* of this spool valve 10 has first and second wedge-shaped channels 48*a* and 48*b* machined into it. The flat faces 49*a–d* of this rod would usually provide directional control for the spool 33*a* of FIGS. 1–13. (This will be explained in connection with FIGS. 8–13 below.) The spool body 33*d*, however, is modified so that proportional control is achieved with control rod 50*e*.

An important feature of the control rod 50*e* is that it is designed to be pressure balanced. Note that a third radial bore 41*a* and fourth radial bore 42*a* are provided in the valve body 33*d*. The third radial bore 41*a* is circumferentially displaced from the first radial bore 41, so that the third radial bore will be in fluid communication with the pressure inlet port 24 at the same time as the first radial bore. Likewise, the fourth radial bore 42*a* is circumferentially displaced from the second radial bore 42, so that the fourth radial bore will be in fluid communication with the second pressure return port 26 at the same time as the second radial bore. It is preferred that the third and fourth radial bores 41*a* and 42*a* are circumferentially displaced 180 degrees from the first and second radial bores 41 and 42, respectively. Further, it is preferred that the second and fourth radial bores 42 and 42*a* are displaced 90 degrees from the first and third radial bores 41 and 41*a*.

In the central null position, the control rod 50*e* covers the first, second, third and fourth radial bores. If the control rod is rotated counterclockwise, the control rod 50*e* will keep the second and fourth radial bores 42 and 42*a* covered, while it uncovers the first and third radial bores 41 and 41*a*. Fluid from the pressure inlet port 24 will then flow into the first and third radial bores 41 and 41*a* and along the first and second channels 48*a* and 48*b* into the gap 74. Because the first and third radial bores 41 and 41*a* are diametrically opposed and the first and second channels 48*a* and 48*b* are diametrically opposed, the fluid forces acting on both sides of the control 50*e* will offset each other. When the control rod 50*e* is rotated clockwise, the first and third radial bores 41 and 41*a* will be covered, and the second and fourth radial bores 42 and 42*a* will be opened. Again, the net force on the control rod 50*e* due to fluid flow along the first and second channels 48*a* and 48*b* and the second and fourth radial bores 42 and 42*a* will be zero.

The control rods depicted in most of the other embodiments of this specification have fluid flow on only one side. While this arrangement will normally work fine, in certain hydraulic applications high fluid pressures may push the rod against the wall of the cylindrical bore 40 of the valve body 33. Additional rotational force is then required to turn the control rod, and the control rod is prone to frictional wear and binding.

The pressure balanced control rod configuration avoids these potential problems. The opposed radial bores and control rod 50*e* are designed to maintain countervailing forces on opposite sides of the control rod. Thus, less rotational force is required to turn the control rod, and the control rod is not subject to friction caused by scraping the wall of the cylindrical bore 40.

Of course, it should be understood that the valve bodies and control rods in all the embodiments shown herein can be easily modified to include this pressure balance feature. The pressure balanced control rod feature is shown in only one embodiment for the sake of simplicity.

To provide proportional control for the valve shown in FIG. 16, the spool body 33*d* is provided with a nut 71 which rotates about a fixed, threaded shaft 67. The nut 71 is secured in one end of the spool body 33*d*. In FIG. 16 the nut 71 is fixed in the control land 34 so that it is concentric with the cylindrical bore 40. The threaded shaft 67 is mounted in the end cap 13*a* of the valve housing 12 and locked into an angular position by a set screw 69. A sealing ring 70 is provided around the periphery of the shaft 67 to prevent leakage. C-rings 75 keep the shaft in a fixed axial orientation.

It should be noted that the control rod 50*e* does not extend completely through the axial bore 40, although it does extend past the second and fourth radial bores 42 and 42*a*. The left end of the control rod should be sufficiently stiff to keep the control rod in place in the spool body 33*d*. A gap 74 is formed between the right end of the control rod 50*e* and the left end of the shaft 67. The thread 68 of the shaft 67 provides a path for fluid between the gap 74 and the first chamber 31 of the second diameter portion 22 of the axial bore 20. One or more drain channels 73 and vent hole 72 can also be drilled into the shaft 67 to provide further means for fluid communication between the the gap 74 and the first chamber 31.

In operation the spool 33*d* would normally travel to its extreme right or left end when the directional-type control rod 50*e* is rotated. In this embodiment, however, the spool 33*d* will rotate about the thread 68 of the shaft 67 as it moves axially in the housing bore 20. The rotation of the spool will close off the radial bores 41, 41*a*, 42 and 42*a* in the proportional manner described above in connection with FIGS. 1–7. When the control rod is rotated to connect the first chamber 31 with either the pressure inlet port 24 or second pressure return port 26 (T2), fluid will travel between the gap 74 and the first chamber 31 via the threads 68 and drain channel 73 and vent hole 72.

The threaded shaft 67 of the valve 10 shown in FIG. 16 is also designed to allow easy central null position adjustment. The set screw 6g can be loosened and the right end of the shaft 67 manually turned from outside the valve housing 12. Since the shaft 67 is held in place axially by the C-rings 75, the shaft 67 will move the spool 33*d* to the right or left as it is rotated. If there is leakage between the pressure inlet port 24 and any other port when the spool 33*d* has IO stabilized (i.e. all radial holes 41, 41*a*, 42 and 42*a* are covered by the control rod 50*e*), the axial displacement of the spool 33*d* will eventually stop the leakage without uncovering any radial bore. The directional control shape of the control rod 50*e* assures that no radial bore is uncovered as the spool 33*d* is shifted in this manner, which is important because uncovering one of the radial bores would cause the spool 33*d* to move again to its null position.

Turning now to FIGS. 8–10, the present invention is embodied in a directional control spool valve 10. The only structural difference between this valve and the valves described in connection with FIGS. 1–7 is the shape of the control rod 50*b*. Instead of slanted faces 51, this control rod 50*b* has a flat area 54 machined into one side between two perpendicular faces 51*e*.

When the control rod 50*b* is rotated either clockwise or counterclockwise, whether a little bit or a lot, the spool 33*a* will move axially to its extreme end of travel. Thus, the directional-type of control rod 50*b* just turns the valve 10 full on and off. It does not provide any proportional control, although it still has the inherent feedback and damping features.

FIGS. 11–13 show a double-ended implementation of the present invention in a 2-position, 3-way valve 10*a*. In this embodiment the valve housing 12*a* has only one pressure return port 25 (T) and one service port 27 (A). The axial bore 20 is one diameter throughout the valve housing 12*a*. The spool body 33*b* has only two outer lands 35 and only one inner land 37 which are closely received within the diameter of the axial bore 20. The two outer lands 35 define a right chamber 82 and a left chamber 81 at opposite ends of the axial bore 20. The first and second radial bores 41 and 42 are spaced apart on opposed sides of the inner land 37. The pressure inlet port 24, pressure return port 25 and service port 27 are axially spaced apart so that in the central null position the inner land 37 blocks the service port (A) and isolates the pressure inlet port (P) from the pressure return port (T). Also, at central null, the first radial bore 41 is in fluid communication with the pressure inlet port 24, and the second radial bore 42 is in fluid communication with the pressure return port 25.

The control rod 50*c* is machined to have first and second flats 54*a* and 54*b* machined into a portion of it. The first flat 54*a* creates a first pocket 55*a* in the cylindrical bore 40, and the second flat 54*b* creates a second pocket 55*b* in the cylindrical bore 40. A first channel 53*a* connects the first pocket 55*a* to the left chamber 81, while a second channel 53*b* connects the second pocket 55*b* to the right chamber 82.

When the control rod 50*c* is rotated either clockwise or counterclockwise in this double-ended implementation, both radial bores 41 and 42 will be uncovered. Each radial bore, however, will be separately connected to either the right chamber 82 or left chamber 81 and either the pressure inlet port 24 or the pressure return port 25.

For example, when the control rod 50*c* is rotated clockwise, the first radial bore 41 will open to put the pressure inlet port 24 in fluid communication with the first pocket 55*a* and the left chamber 81 via the first channel 53*a*. At the same time, the second radial bore 42 will open to put the pressure return port 25 in fluid communication with the second pocket 55*b* and the right chamber 82 via the second channel 53*b*. Thus, the left chamber 81 will be connected to high pressure (port P) while the right chamber 82 will be connected to low pressure (port T). The pressure imbalance will force the spool 33*b* to the right until the spool reaches its end of travel. Fluid communication will then be established between the pressure inlet port (P) and the service port (A).

When the control rod 50*c* is rotated counterclockwise, the first radial bore 41 will connect the pressure inlet port 24 to the right chamber 82 and second radial bore 42 will connect the pressure return port 25 to the left chamber Sl. The spool 33*b* will then shift to the left until it reaches its other end of travel. Fluid communication will then be established between the service port (A) and the pressure return port (T).

The double-ended implementation of the present invention drives the spool 33*a* from both ends by using a pilot valve on each end. This implementation yields a symmetrical valve configuration, but requires an additional flat machined on the control rod.

The double-ended implementation of the present invention shown in FIGS. 11–13 only provides directional control since the two pockets 55*a,b* are defined by flat sections between two faces 51*e* cut at 90 degrees to the axis of the control rod 50*c*. This double-ended implementation could also be adapted to provide proportional control. For example, each flat could be bordered by two slanted faces at supplementary angles, like the embodiments shown in FIGS. 1–7 above.

FIGS. 14–15*b* show the present invention embodied in a cartridge valve 10*b*. These valves are characterized as having a hard seat so that they do not leak when closed. They are primarily used as logic elements (on-off), and they can be controlled using a pilot valve.

The cartridge valve 10*b* in FIGS. 14–15*b* include a valve housing 12*b*, a cartridge-type valve body 33*c*, and a control rod 50*d*. The valve housing 12*b* has an axial bore 20 extending between a first closed end 13 and a second closed end 17. The axial bore has a first diameter portion 21 and a smaller second diameter portion 22. A hard valve seat 64 is machined into the valve housing between the first and second diameter portions. A pressure inlet port 24 (P) and service port 27 (A) are located at axially spaced positions in the valve housing 12*b* and communicate with first diameter portion 21 and the second diameter portion 22, respectively.

The cartridge body 33*c* has a first land 65 snugly fitting in the first diameter portion 21, a second land 62 having a smaller diameter than the first diameter portion 21, and a third land 63 having a smaller diameter than the second diameter portion 22. The first land 65 creates a chamber 83 at the left end of the first diameter portion 21 of the axial bore 20. The diameters of the second and third lands should be sufficiently smaller than the first and second diameter portions, respectively, to allow adequate fluid flow around these lands. A first radial bore 41 is drilled in the second land 62, and a second radial bore 42 is drilled in the third land 63. The cartridge 33*c* has a cylindrical bore 40 extending along its longitudinal axis. The first and second radial bores 41,42 communicate with the cylindrical bore 40.

The cylindrical control rod 50*d* passes through an opening in the second closed end 17 of the valve housing 12*b* and extends through the length of the cylindrical bore 40. An o-ring 44 is provided in the second closed end 17 to prevent leakage. A flat 54 is machined into a section of the control rod 50*d* and extends from beyond the first land 65 and past the second radial bore 42.

The pressure inlet port 24 and service port 27 are axially spaced apart on the valve housing 12*b* so that when the cartridge 33*c* is enclosed in the valve housing the first radial bore 41 is in fluid communication with the pressure inlet port (P) and the second radial bore 42 is in fluid communication with the service port (A). The other elements shown in FIGS. 14–15*b*, such as the torque actuator 56, the CPU 57, the key way passage 45 and the key 46, function in the same manner described above in connection with FIGS. 1–6.

The cartridge valve 10*b* basically has two operational states. In the first state, the control rod 50*d* is rotated to uncover the first radial bore 41 and, thus, cover the second radial bore 42. Fluid from the pressure inlet port 24 then flows into the left chamber 83 via the first radial bore 41 and the gap 55 created by the flat 54. The high pressure in the left chamber forces the first land 65 and the cartridge 33*c* to the right until the second land 62 firmly abuts against the valve seat 64. (Note that the area of the left side 65*a* of the first land 65 is much larger than the area of the right side 65*b*.) The pressure inlet port (P) is then shut off from the service port (A).

In the second state, the control rod 50*d* is rotated in the opposite direction so as to cover the first radial bore 41 and uncover the second radial bore 42. The left chamber 83 is then connected to the service port (A) via the gap 55 created by the flat 54 and the second radial bore 42. The fluid rushing in from the pressure inlet port (P) constantly pushes against the right side 65*b* of the first land 65 and forces the cartridge 33*c* to the left. The fluid in the left chamber 83 will be at lower pressure and thus will be forced down the gap 55 to the service port (A). The second land 62 will move away from the valve seat 64 so that the pressure inlet port (P) will be in fluid communication with the service port (A). The second closed end 17 will stop the cartridge's movement to the left.

It should be apparent from the foregoing discussion that the present invention provides a pilot stage for a variety of valves with significant advantages over prior approaches. For example, the present invention can be easily and inexpensively made and adapted to a wide range of valves. In most cases, the spool or cartridge merely has to be machined to include the cylindrical bore and radial bores and a control rod has to be shaped to meet the needs of the particular application. In every application, the pilot valve of the present invention provides inherent damping and feedback, and proportional control can be easily implemented.

Furthermore, since the control rod is of low mass and has low frictional forces acting on it, low power actuators can be used to rotate the rod. (The fluid amplifying properties of the pilot stage reduce the input power control requirements.) The rotation of the control rod can be implemented manually (e.g., a hand-turned dial) or a computer-controlled rotary actuator.

It should be understood that various changes and modifications to the preferred embodiments described above will be apparent to those skilled in the art. For example, in the embodiments shown in FIGS. 1–7, the control land 34 could be placed at the left end of the spool 33*a* and the rest of the valve 10 modified accordingly so that it would essentially be the converse of the embodiments shown in FIGS. 1–7. Alternatively, the second radial bore 42 could be located on the spool 33*a* so that it is in fluid communication with the first pressure return port 25 (T1) in the central null position. The shape of the control rod 50 could be modified so that the control land 34 still remains on the right side of the spool 33*a*. It should also be apparent that the 2-position, 4-way valve 10 in FIGS. 1–10 could be adapted to the double-ended implementation shown in FIGS. 11–13. Conversely, the double-ended implementation shown in FIGS. 11–13 for a 2-position, 3-way valve 10*a* could be changed to the single-ended implementation shown in FIGS. 1–10. It is also possible that the axial bore 20 in the valve housings shown in FIGS. 1–15*b* could be other than cylindrically shaped, since the valve bodies 33 in these embodiments do not rotate.

It is intended that the foregoing description be regarded as illustrative rather than limiting, and that it be understood that it is the following claims, including all equivalents, which are intended to define the scope of the invention.

I claim:

1. For use in a valve housing having a first end with an opening and a second closed end, an axial bore extending between the first and second ends and a plurality of ports connected to the axial bore: a valve body that is laterally displaced within the axial bore by fluid pressure to open and close one or more ports, the valve body having two outer lands and at least one inner land, a first outer land being positioned adjacent to the first end of the valve housing and a second outer land being positioned adjacent to the second end of the valve housing, a cylindrical, lateral control bore extending the length of the valve body and being used to transmit both high and low pressure fluid for controliing the lateral displacement of the valve body, and first and second radial bores axially spaced apart between the two outer lands and coupled to the lateral control bore, and a controll rod extending through the opening in the first end of the valve housing, inserted in the lateral control bore and rotatable therein, the control rod having a passageway for both high and low pressure fluid that begins within the lateral control bore and extends to the end of the control rod nearest the second end of the valve housing, the passageway shaped so that in a first angular position the control rod covers both the first and second radial bores and neither radial bore is coupled to the passageway, in a second angular position the control rod uncovers the first radial bore, so that it is coupled to the passageway leading to the second end of the valve housing, and in a third angular position the control rod uncovers the second radial bore so that it is coupled to the passageway leading to the second end of the valve housing.

2. The invention of calim 1 further including means for preventing rotation of the valve body within the axial bore.

3. The invention of claim 1 wherein the valve body includes only one lateral bore.

4. A spool-type valve comprising:

a valve housing having a first end with an opening, a second closed end, and an axial bore therebetween, a pressure inlet port, at least one pressure return port, and at least one service port, all the ports being connected to the axial bore at axially spaced positions;

a spool that is laterally displaced within the axial bore by fluid pressure, the spool having two outer lands and at least one intermediate land, a cylindrical, lateral control bore extending the length of the spool and being used to transmit both high and low pressure fluid for controlling the lateral displacement of the spool, and first and second radial bores located between the two outer lands and on opposite sides of an intermediate land, and coupled to the lateral control bore;

the housing ports axially spaced apart so that when the spool is in a first position within the axial bore the pressure inlet port is isolated from the pressure return port by a intermediate land, the service port is blocked by an intermediate land, the first radial bore is in fluid communication with the pressure inlet port, and the second radial bore is in fluid communication with a pressure return port; and a control rod extending through the opening of the first end of the valve housing and inserted in the lateral control bore and rotatable therein, the control rod having a passageway that begins within the lateral control bore and extends to the end of the control rod nearest to the second end of the valve housing, the passageway being shaped so that in a first angular position the control rod covers both the first and second radial bores and neither radial bore is coupled to the passageway, in a second angular position the control rod uncovers the first radial bore, so that the first radial bore and pressure inlet port are coupled to the passageway, and in a third angular position the control rod uncovers the second radial bore, so that the second radial bore and the pressure return port are coupled to the passageway.

5. The invention of claim 4 further including means for preventing rotation of the spool within the axial bore.

6. The invention of claim 2 wherein the spool includes only one lateral bore.

7. The invention of claim 4 wherein the first and second radial bores are on immediate opposite sides of the intermediate land.

8. The invention of claim 4 further comprising a flexible coupling for the control rod, positioned between the spool and the first end of the housing.

9. A spool-type valve comprising:

a valve housing having a first end with an opening and a closed second end connected by a bore extending therebetween, the bore having a first diameter portion adjacent, the first end and a second diameter portion adjacent the second end and adjoining the first diameter portion, the second dimeter being a different size than the first diameter;

a spool that is laterally displaced within the axial bore by fluid pressure, the spool having a control land closely received in the second diameter portion, two outer lands and two inner lands closely received in the first diameter portion, a cylindrical, lateral control bore extending the length of the spool and being used to transmit both high and low pressure fluid for controlling the lateral displacement of the spool, and first and second radial bores located between the two outer lands on immediate opposite sides of an inner land, and coupled to the lateral control bore;

the valve housing further having a pressure inlet port, first and second pressure return ports, and first and second service ports, all the ports communicating with the first diameter portion at axially spaced positions so that when the spool is in a first axial position one inner land isolates the pressure inlet port from the first pressure return port and blocks the first service port, the other inner land isolates the pressure inlet port from the second pressure return port and blocks the second service port, the first radial bore is in fluid communication with the pressure inlet port and the second radial bore is in fluid communication with the first pressure return port;

the valve housing also having a passage connecting the pressure inlet port to the second diameter portion on a first side of the control land; and a cylindrical control rod extending through the opening of the first end of of the valve housing, inserted in the lateral control bore and rotatable therein, the control rod having a passageway that begins within the lateral control bore and extends to the end of the control rod nearest the second end of the valve housing, the passageway configured so that in a first angular position the control rod covers both the first and second radial bores and neither radial bore is coupled to the passageway, in a second angular position the control rod uncovers the first radial bore and couples it to the passageway, while covering the second radial bore, so that the pressure inlet port communicates with the second diameter portion of the valve housing on a second side of the control land, and in a third angular position the control rod uncovers the second radial bore and couples it to the passageway, while covering the first radial bore, so that the first pressure return port communicates with the second diameter portion of the valve housing on the second side of the control land.

10. The invention of claim 9 wherein the area of the first side of the control land is half the area of the second side of the control land.

11. The invention of claim 9 wherein the control rod has two faces cut at supplementary angles and spaced apart by a rod of smaller diameter so that a gap is created in the lateral control bore between the faces, and a channel connecting the gap to the second diameter portion on the second side of the control land, the gap and channel forming the passageway.

12. The invention of claim 9 wherein the valve housing passage includes a metering orifice.

13. The invention of claim 9 further including means for preventing rotation of the spool within the axial bore.

14. The invention of claim 9 wherein the spool inc-1udes only one lateral bore.

15. A spool-type valve comprising:

a valve housing having a first end with an opening and a closed second end connected by an axial bore extending therebetween, a pressure inlet port, a pressure return port, and a serivce port, all the ports communicating with the bore at axially spaced position;

a spool that is laterally displaced within the axial housing bore by fluid pressure, the spool having two outer lands and one inner land, a cylindrical, lateral control bore extending the length of the spool and being used to transmit both high and low pressure fluid for controlling the lateral displacement of the spool, and first and second radial bores located between the two outer lands on immediate opposite sides of the inner land and coupled to the lateral control bore;

the housing ports axially spaced apart so that when the spool is in a first axial position the inner land isolates the pressure inlet port from the pressure return port and blocks the service port, the first radial bore is in fluid communication with the pressure inlet port, and the second radial bore is in fluid communication with the pressure return port; and a cylindrical control rod extending through the opening in the first end of the valve housing, inserted in the lateral control bore and rotatable therein, the control rod having a passageway that begins within the lateral control bore and extends to the end of the control rod nearest the second end of the valve housing, the passageway being configured so that in a first angular position the control rod covers both the first and second radial bores and neither radial bore is coupled to the passageway, in a second angular position the control rod uncovers the first radial bore, so that the first radial bore and the pressure inlet port are coupled to the passageway, and in third angular position the control rod uncovers the second radial bore, so that the second radial bore and the pressure return port are coupled to the passageway.

* * * * *

UNITED STATES PATENT AND TRADEMARK OFFICE

CERTIFICATE OF CORRECTION

PATENT NO. : 4,683,915

DATED : August 4, 1987

INVENTOR(S) : Harry M. Sloate

It is certified that error appears in the above-identified patent and that said Letters Patent is hereby corrected as shown below:

IN THE BACKGROUND OF THE INVENTION

In column 1, line 13, please delete "amoun" and substitute therefor --amount--.

IN THE SUMMARY OF THE INVENTION

In column 3, line 6, please delete "can used" and substitute therefor --can be used--.

IN THE DETAILED DESCRIPTION OF PREFERRED EMBODIMENTS

In column 7, line 35, please delete "and 29" and substitute therefor --and 28--;

In column 11, line 56, please delete "6g" and substitute therefor --69--;

In column 11, line 62, please delete "has IO stabilized" and substitute therefor --has stabilized--;

In column 13, line 3, please delete "S1" and substitute therefor --81--.

UNITED STATES PATENT AND TRADEMARK OFFICE

CERTIFICATE OF CORRECTION

PATENT NO. : 4,683,915

DATED : August 4, 1987

INVENTOR(S) : Harry M. Sloate

It is certified that error appears in the above-identified patent and that said Letters Patent is hereby corrected as shown below:

IN THE CLAIMS

In Claim 1 (column 15, line 22), please delete "controliing" and substitute therefor --controlling--;

In Claim 1 (column 15, line 26), please delete "controll" and substitute therefor --control--;

In claim 2 (column 15, line 42), please delete "calim 1" and substitute therefor --claim 1--;

In claim 4 (column 15, line 67), please delete "a intermediate" and substitute therefor --an intermediate--;

In claim 6 (column 16, line 24), please delete "claim 2" and substitute therefor --claim 4--;

In claim 9 (column 16, line 36), please delete the comma (,) after the word "adjacent";

In claim 9 (column 16, lines 38-39), please delete "dimeter" and substitute therefor --diameter--;

In claim 9 (column 17, line 2), please delete one of the two words "of of";

UNITED STATES PATENT AND TRADEMARK OFFICE

CERTIFICATE OF CORRECTION

PATENT NO. : 4,683,915

DATED : August 4, 1987

INVENTOR(S) : Harry M. Sloate

It is certified that error appears in the above-identified patent and that said Letters Patent is hereby corrected as shown below:

In claim 15 (column 18, line 4), please delete "serivce" and substitute therefor --service--;

In claim 15 (column 18, line 6), please delete "position" and substitute therefor --positions--;

In claim 15 (column 18, line 37), please delete "in third" and substitute therefor --in a third--.

Signed and Sealed this

Twelfth Day of July, 1988

*Attest:*

*Attesting Officer*

DONALD J. QUIGG

*Commissioner of Patents and Trademarks*